US006397864B1

(12) United States Patent
Johnson

(10) Patent No.: US 6,397,864 B1
(45) Date of Patent: Jun. 4, 2002

(54) NOZZLE ARRANGEMENT FOR WELL CLEANING APPARATUS

(75) Inventor: Ashley B. Johnson, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/262,893

(22) Filed: Mar. 8, 1999

(30) Foreign Application Priority Data

Mar. 9, 1998 (GB) ..... 9804690

(51) Int. Cl.[7] ..... B08B 3/02

(52) U.S. Cl. ..... 134/167 C; 134/169 C; 134/198; 166/223; 166/171

(58) Field of Search ..... 134/166 R, 167 R, 134/168 C, 167 C, 166 C, 169 R, 198; 15/104.31, 104.05, 104.16; 166/222, 223, 171, 172, 56

(56) References Cited

U.S. PATENT DOCUMENTS 778,903 A * 1/1905 Schussler ..... 15/104.31
RE13,032 E * 11/1909 Greenan ..... 15/104.32
951,202 A * 3/1910 Shrik ..... 15/104.31
1,274,931 A * 8/1918 Otterson ..... 15/104.31
1,279,333 A * 9/1918 Green
1,344,249 A * 6/1920 Stwart ..... 15/104.31
1,424,109 A * 7/1922 Mbride ..... 15/104.31
1,498,446 A * 6/1924 Gesky ..... 15/104.31
1,568,392 A * 1/1926 Abernathy ..... 15/104.31
1,994,209 A * 3/1935 Burns ..... 15/104.31
2,099,723 A * 11/1937 Carver ..... 15/104.31
2,167,194 A * 7/1939 Anderson
2,239,586 A * 4/1941 Appleby
3,130,786 A * 4/1964 Brown et al.
3,310,113 A * 3/1967 Maness
3,348,616 A * 10/1967 Zingg
3,449,783 A * 6/1969 Kirschke ..... 134/167 R
3,589,388 A * 6/1971 Haneline, Jr.
3,839,875 A * 10/1974 Matsushita
3,994,310 A * 11/1976 Brandon ..... 134/167 C
4,037,661 A * 7/1977 Ford
4,071,919 A * 2/1978 Fields ..... 134/167 C
4,157,096 A * 6/1979 Miller, Jr.
4,196,050 A * 4/1980 Takahashi et al.
4,197,910 A * 4/1980 Hutchison
4,271,556 A * 6/1981 Farrell, Jr. ..... 15/104.31
4,299,282 A * 11/1981 Thornton
4,349,073 A * 9/1982 Zublin
4,441,557 A * 4/1984 Zublin ..... 134/167 C
4,501,322 A * 2/1985 Martin
4,503,811 A * 3/1985 Hammond
4,518,041 A * 5/1985 Zublin ..... 134/167 C
4,688,637 A * 8/1987 Theis
4,705,107 A * 11/1987 Council et al.
4,718,728 A * 1/1988 Hodges
4,763,728 A * 8/1988 Lacey ..... 134/167 C
4,788,732 A * 12/1988 Kollmar
4,923,021 A * 5/1990 Courmier et al.
5,060,725 A 10/1991 Buell
5,125,425 A * 6/1992 Folts et al.
5,174,394 A * 12/1992 Fischer et al.
5,230,306 A * 7/1993 Barringer et al.
5,305,713 A * 4/1994 Vadakin
5,323,797 A * 6/1994 Rankin
5,379,476 A * 1/1995 Salecker ..... 15/104.31
5,399,056 A * 3/1995 Shibazaki et al.
5,444,887 A * 8/1995 Rufolo ..... 15/104.31
5,463,887 A * 11/1995 Vasseur
5,737,709 A * 4/1998 Getty et al.

(List continued on next page.)

*Primary Examiner*—Frankie L. Stinson

(57) ABSTRACT

An apparatus for cleaning subterranean wellbores is described. The apparatus comprises a rotatable jet head with less than five axially separated nozzles through which an abrasive fluid is discharged. The nozzles are mounted with an axial separation of preferably more than 0.5 times the nozzle diameter.

10 Claims, 3 Drawing Sheets

U.S. PATENT DOCUMENTS 5,762,083 A * 6/1998 Bate ..... 134/167 C
5,778,831 A * 7/1998 Jameel
5,855,219 A * 1/1999 Spencer
5,944,123 A * 8/1999 Johnson
5,996,159 A * 12/1999 Irwin ..... 15/104.31
6,050,337 A * 4/2000 Melegari
6,217,207 B1 * 4/2001 Streich et al.

* cited by examiner

NOZZLE ARRANGEMENT FOR WELL CLEANING APPARATUS

The present invention relates to an improved nozzle arrangement for a jet drilling apparatus. The invention particularly relates to such an apparatus as applied for cleaning of surface and subterranean pipes and boreholes for hydrocarbon reservoir exploration and production, more particularly to the removal of scale and other deposits from the inside diameter of well tubulars and boreholes.

BACKGROUND OF THE INVENTION

It has been common practice for many years to run a continuous reeled pipe (known extensively in the industry as "coil tubing") into a well to perform operations utilising the circulation of treating and cleanout fluids such as water, oil, acid, corrosion inhibitors, hot oil, nitrogen, foam, etc. Coil tubing, being continuous rather than jointed, is run into and out of a well with continuous movement of the tubing through a coil tubing injector.

Coil tubing is frequently used to circulate cleanout fluids through a well for the purpose of eliminating sand bridges, scale, and similar downhole obstructions. Often such obstructions are very difficult and occasionally impossible to remove because of the inability to rotate the coil tubing and drill out such obstructions. These well tubulars vary from unperforated and perforated pipe, large diameter casing, production tubing, and slotted or wire-wrapped well liner. Well tubulars often become plugged or coated with corrosion products, sediments and hydrocarbon deposits. The deposits may consist of silicates, sulphates, sulphide, carbonates, calcium, and organic growth.

It is desirable to perform drilling type operations in wells through use of coil tubing which can be run into and removed from a well quickly in addition to performing the usual operations which require only the circulation of fluids. The same types of well servicing can also be performed with various small diameter work strings. The present invention may be used with such work strings and is not limited to coil tubing.

High pressure fluid jet systems have been used for many years to clean the inside diameter of well tubulars. Examples of such systems are disclosed in the following U.S. Pat. Nos. 3,720,264, 3,811,499, 3,829,134, 3,850,241, 4,088,191, 4,349,073, 4,441,557, 4,442,899, 4,518,041, 4,919,204, 5,181,576 or 5,337,819.

In U.S. Pat. No. 3,720,264, there is disclosed a jet tool for cleaning a liner. The jet tool includes three pairs of jet nozzles arranged in a staggered manner with each pair of nozzles slightly rotated with respect to the others.

In U.S. Pat. No. 4,442,899, the nozzles are circumferentially spaced from each other about 90 degrees and separated such as to form a spiral.

U.S. Pat. No. 5,337,819 discloses a washing tool for removing internal deposits in tubing parts and components in wells for oil and gas production. The known tool comprises an actuation sleeve which has lateral dimensions related to the deposits to be removed. The sleeve actuates a valve to discharge a fluid jet through layers of circumferentially arranged discharge nozzles.

In view of the above cited prior art, it is an object of the invention to provide an improved fluid jet cleaning tool to remove scale and other deposits from the inside diameter of tubulars and boreholes for the exploration and production of hydrocarbon reservoirs. It is a particular object of the invention to provide a novel nozzle arrangement for such a fluid jet cleaning tool.

SUMMARY OF THE INVENTION

According to the present invention there is provided a fluid jet cleaning apparatus for cleaning of tubulars and boreholes for hydrocarbon reservoir exploration and production, said apparatus comprising a rotatable nozzle head including less than five axially separated nozzles mounted on a part of a lower end of a hollow tubular.

It has been recognised that the number of nozzles of a well cleaning tool can be reduced to less than five, preferably less than four without significant loss of performance.

Furthermore, it was found that the efficiency of the tool can be increased over tools with an equal number of nozzles by axially separating the nozzles. The preferred axial separation between two adjacent nozzles is larger than 0.5 times the nozzle diameter, but smaller than 20 times, more preferably 10 times, the nozzle diameter.

The preferred angular separation is either 180 degrees in case of two nozzles, 120 degrees in case of three nozzles or for four nozzles, a separation of 180 degrees between a pair of nozzles with the second pair preferably rotated by 90 degrees with respect to the first pair of nozzles.

The cleaning tool may also comprise a gauge defining sleeve with an essentially annular edge of a width of less than 10 mm, preferably 5 mm. The nozzle located closest to the sleeve is targeted at an area of the tubular or wellbore immediately below the sleeve member.

These and other features of the invention, preferred embodiments and variants thereof, and advantages will become appreciated and understood by those skilled in the art from the detailed description and drawings following below.

MODE(S) FOR CARRYING OUT THE INVENTION

The invention is now described with reference to the attached drawings.

Figure 1:
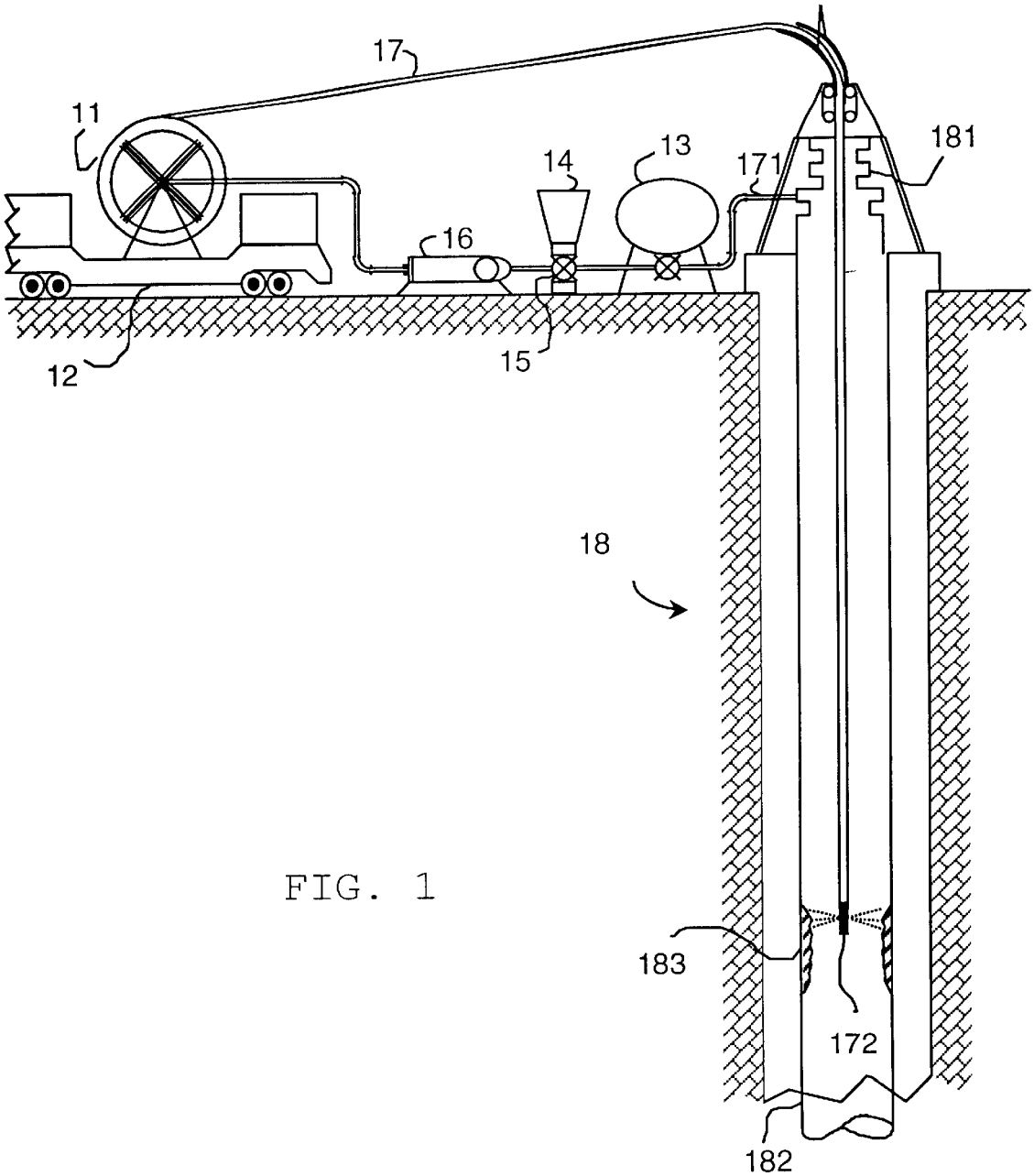
FIG. 1 shows a jet cleaning tool connected to a coiled tubing.

A typical well cleaning operation is illustrated by FIG. 1. The subsurface equipment for well cleaning comprises a coiled tubing reel 11 usually mounted on a truck 12. Connected to the reel there is a cleaning fluid tank 13, a reservoir and feeder for the abrasive material 14. A mixer 15 generates the abrasive slurry applied for deposit removal. A pump unit 16 generates the pressure to circulate the slurry through the coiled tubing 17 and the wellbore 18.

The coiled tubing 17 is fed through the Blow-out Preventer (BOP) stack 181 into the well tubulars 182. A return pipe 171 at the upper end of the well tubulars closes the flow loop through which the cleaning fluid is pumped. Also included in the flow loop (but not shown) are separators to recover the cleaning fluid and/or the abrasives.

In operation, the coiled tubing with a jetting head 172 at its end is lowered into the well 18 to a predetermined depth at which deposits 183 are to be removed. Then the abrasive containing slurry is discharged through the nozzles of the jetting head removing scale at a rate depending on the deposits, jetting speed and stand-off.

Figure 2:
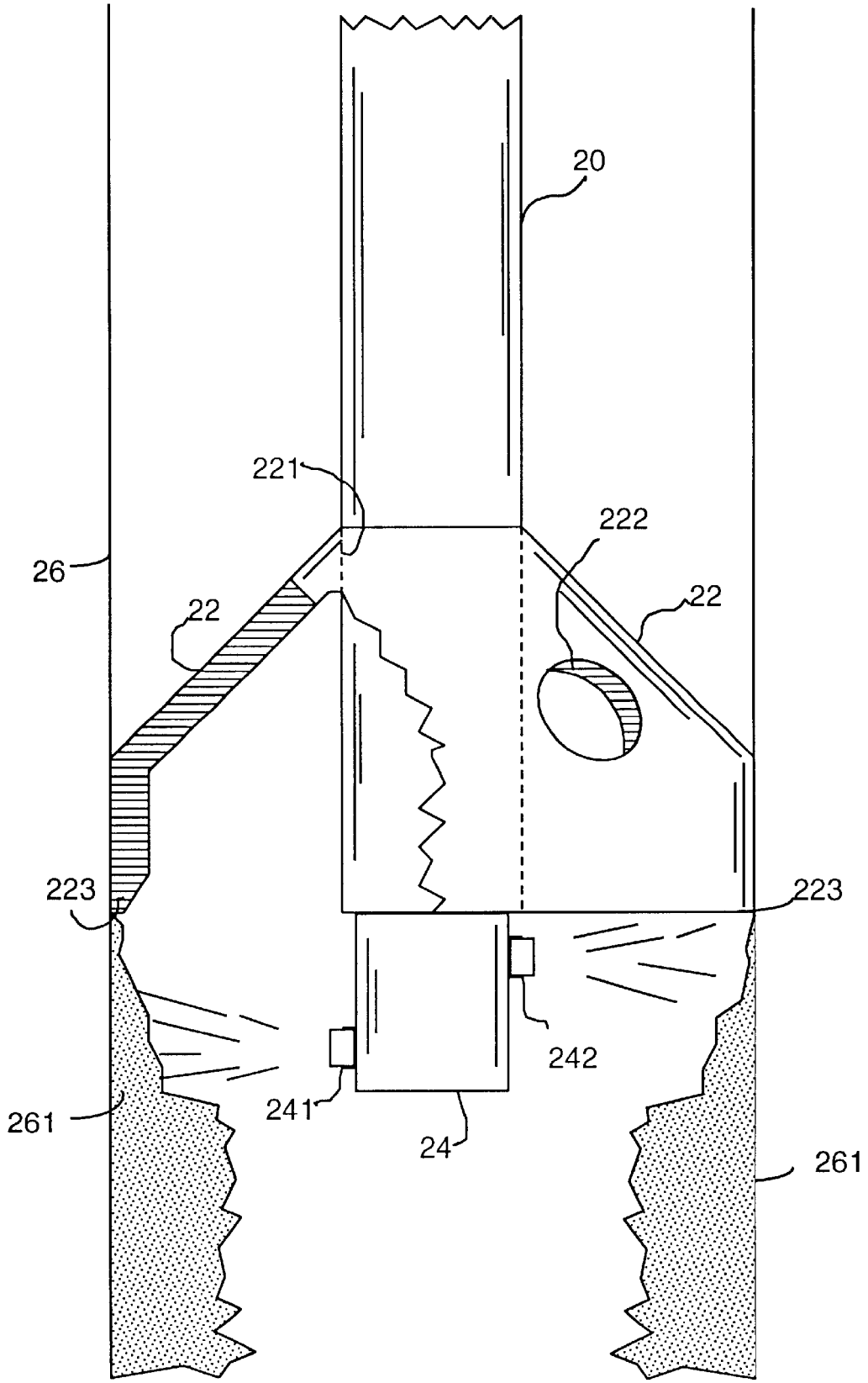
FIG. 2 shows a jet cleaning tool in accordance with a preferred embodiment of the invention.

The basic components of a nozzle arrangement in accordance with the invention are illustrated in FIG. 2. There is shown the lower part 20 of a hollow tube representing a drillstring or a coiled tubing. Attached to the tube is a sleeve member 22. The sleeve member in the described example is made of a solid cylinder of engineering steel with a frustroconically shaped upper end and an outer diameter of 75 mm and a centre bore 221 of 45 mm. An alternative material may be tungsten carbide or other steels of sufficient hardness.

Further components of the system are a nozzle head 24 which carries two axially separated nozzles 241, 242 arranged with a 180 degrees angular separation. The nozzle head is rotatably mounted on the drillstring 20. In operation the first nozzle 241 removes only part of the debris 261, leaving material at a small angle with respect to the wall of the tubular 26. The efficiency of the operation of the second nozzle 242 was found to be linked to this angle (target angle) with increased efficiency at smaller target angles. The second nozzle 242 is directed to the area 223 immediately below the sleeve.

To demonstrate the improved efficiency of the novel arrangements, tests were carried out cutting Stancliffe sandstone and cleaning scaled tubing. Axial separations between the nozzles 241 and 242 were 0, 6, and 20 mm at an angular separation of 180 degrees. Other test conditions were

| | |
|---|---|
| Nozzle diameter: | 2.8 mm |
| Stand-off: | 15 mm |
| Nozzle pressure drop: | 130 B |
| Vessel pressure: | 210 B |
| Jetting media (for Stancliffe): | water |
| Jetting media (for scale): | calcite pellets |
| Rotary speed: | 80 rpm |

Figure 3:
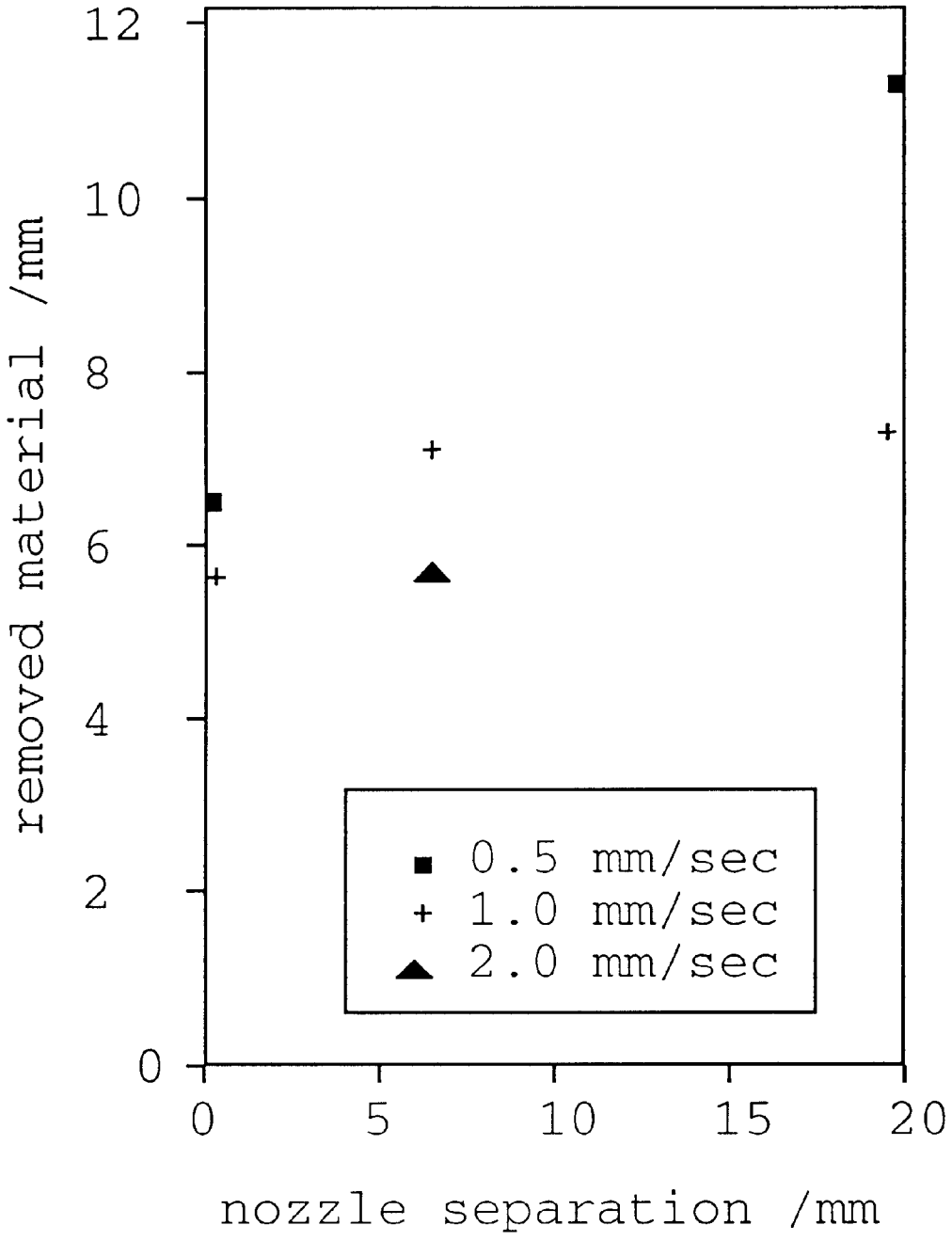
FIG. 3 illustrates the improved efficiency of the novel nozzle arrangement over known arrangements.

The results of the test are shown in FIG. 3 as material removed versus nozzle separation at various tool propagation speeds. A clear tendency for improved cutting efficiency at larger nozzle separation is demonstrated enabling operations at higher tool propagation speed for the same level of material removal.

What is claimed is:

1. Fluid jet cleaning apparatus for cleaning of tubulars and boreholes for hydrocarbon reservoir exploration and production, said apparatus comprising:

mounted on a part of a lower end of a hollow tubular, a nozzle head rotatable with respect to the lower end of the hollow tubular, the nozzle head including less than five axially and angularly separated nozzles, each nozzle being spaced apart from each other nozzle by a predetermined distance in a direction along the central axis of the hollow tubular and a predetermined angle as measured from the central axis.

2. The apparatus of claim 1, wherein the number of nozzles is two or three.

3. The apparatus of claim 1, wherein the axial separation between two nozzles is at least 0.5 times the nozzle diameter.

4. The apparatus of claim 1, wherein the nozzles are arranged clockwise or counterclockwise with an essentially uniform angular spacing.

5. The apparatus of claim 1, wherein the angular separation of the nozzles is 180 degrees for a pair of nozzles or 120 degrees for three nozzles.

6. The apparatus of claim 5, wherein the leading edge has openings allowing fluid to pass through the sleeve member.

7. The apparatus of claim 1, further including a gauge defining sleeve member arranged such that a fluid jet discharged from one of the nozzles targets an area of the tubular or wellbore immediately below said sleeve member.

8. The apparatus of claim 7, wherein sleeve member has an essentially annular edge of a width of less than 10 mm.

9. The apparatus of claim 7, wherein sleeve member has an essentially annular edge of a width of less than 5 mm.

10. The apparatus of claim 1 attached to a lower part of coiled tubing.

* * * * *